US006378442B1

(12) United States Patent
Gebhard

(10) Patent No.: US 6,378,442 B1
(45) Date of Patent: Apr. 30, 2002

(54) CAR BODY

(75) Inventor: Bruno Gebhard, Forchheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/000,002

(22) PCT Filed: Jul. 8, 1996

(86) PCT No.: PCT/DE96/01230

§ 371 Date: Jun. 1, 1998

§ 102(e) Date: Jun. 1, 1998

(87) PCT Pub. No.: WO97/03873

PCT Pub. Date: Feb. 6, 1997

(30) Foreign Application Priority Data

Jul. 21, 1995 (DE) ..... 195 26 724

(51) Int. Cl.[7] ..... B60L 9/00; B60R 16/00

(52) U.S. Cl. ..... 104/288; 296/225; 224/400

(58) Field of Search ..... 104/287, 288, 104/295; 296/225; 220/1.5, 4.01, 4.02; 224/400, 401, 29.5, 309; 52/45

(56) References Cited

U.S. PATENT DOCUMENTS

| | | | |
|---|---|---|---|
| 3,190,515 A | 6/1965 | Viette | 224/42.1 |
| 3,503,547 A | 3/1970 | Shields | 224/42.1 |

FOREIGN PATENT DOCUMENTS

| | | |
|---|---|---|
| DE | 92 15 814.5 | 3/1993 |
| DE | 43 33 437 | 1/1995 |

*Primary Examiner*—S. Joseph Morano
*Assistant Examiner*—Robert J. McCarry, Jr.
(74) *Attorney, Agent, or Firm*—Kenyon & Kenyon

(57) ABSTRACT

A roof-mounted container with a base frame where electrical apparatuses can be mounted; at least one hood can be set on the base frame. Electrical apparatuses can be mounted and wired in such a roof-mounted container independently of the car body being finished.

15 Claims, 4 Drawing Sheets

CAR BODY

FIELD OF THE INVENTION

The present invention relates to a car body with at least one roof-mounted container for accommodating electrical apparatuses of the drive and car control of rolling stock and trolley buses.

BACKGROUND INFORMATION

A roof-mounted container for a car body is described in, for example, German Patent No. 43 33 437. The roof-mounted container described therein accommodates electrical apparatuses and wiring, and is part of the car roof. Electrical apparatuses and their wiring can be mounted in the roof container only after the car body has been finished.

Another roof-mounted container is described in German Utility Application 92 15 814. The housing of this roof-mounted container is formed by a rectangular bottom, two side walls, and two end walls. The housing can be covered by a single-piece cover, which covers the entire area of the housing. In order to provide good accessibility to the components arranged in the housing from both sides, detachable articulations are arranged on the upper edges of both side walls. These allow the housing cover to be swung open from either side.

SUMMARY OF THE INVENTION

An object of the present invention is to provide a roof-mounted container that allows electrical apparatuses to be mounted and wired in it in a simple manner, and independent of a car body being finished.

The roof-mounted container includes a rectangular base frame having two longitudinal supports and two transversal supports. At least one additional longitudinal support and/or at least one additional transversal support may be arranged within the base frame. Electrical apparatuses may be mounted on the base frame. Additionally, at least one hood may be provided on the base frame The base frame is mounted on the overhead support of the car body and is sealed against the end walls and side walls of the car body.

Through the design of the base frame, and by having the base frame and the hood designed as separate components, electrical apparatuses, such as traction converters and on-board electrical system converters, as well as plates (boards) equipped with electrical apparatuses, may be mounted in the roof-mounted container. After the electrical apparatuses have been mounted and wired, the hood may be set up. The roof-mounted container can thus be pre-assembled in a simple manner. Subsequently, according to the present invention, only the roof-mounted container with its base frame is positioned on a portal support of the car body, and is sealed against the end walls and side walls of the car body.

Different materials can be advantageously paired in the roof-mounted container for a car body. Thus, for example, both the base frame and the hood may be made of an electrically conductive material. The electrically conductive materials may be different, for example, the base frame may be made of steel, and the hood of aluminum. An improved electromagnetic compatibility ("EMC") protection is thus obtained. On the other hand, if the base frame is made of an electrically insulating material, an intermediary potential can be advantageously built up. The build-up of an intermediary potential is necessary, for example, in the case of trolley buses (O-buses).

Improved electromagnetic compatibility is also achieved with a roof-mounted container for a car body.

In addition, in a roof-mounted container, fire-protection requirements are met in a simple manner. At the same time, EMC protection is improved by the use of the frame cover.

The roof-mounted container for a car body also advantageously provides superior EMC protection through the separation of the power wiring from the other electric components.

DETAILED DESCRIPTION OF THE INVENTION

Figure 1:
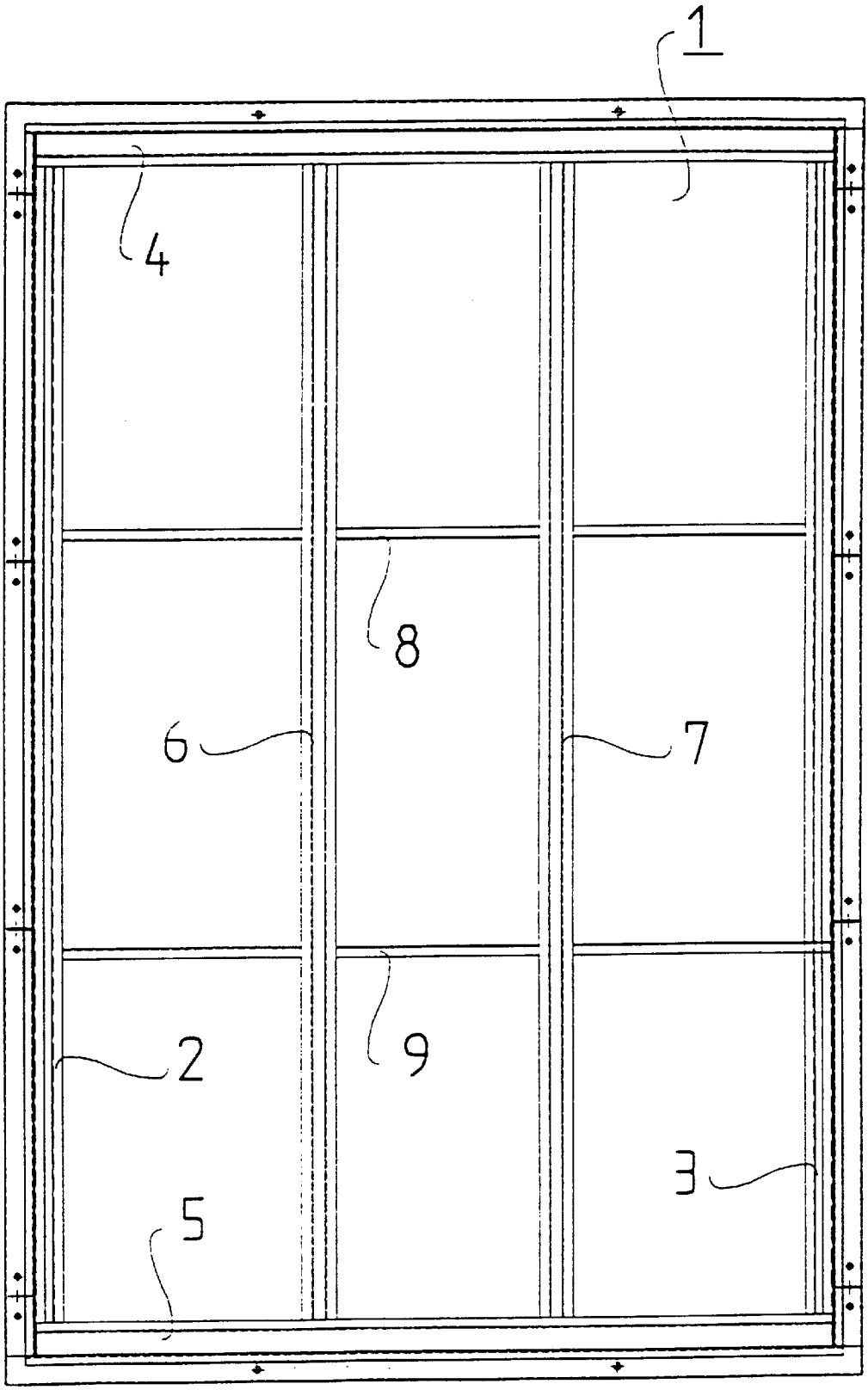
FIG. 1 shows a top view of a base frame.
Figure 2:
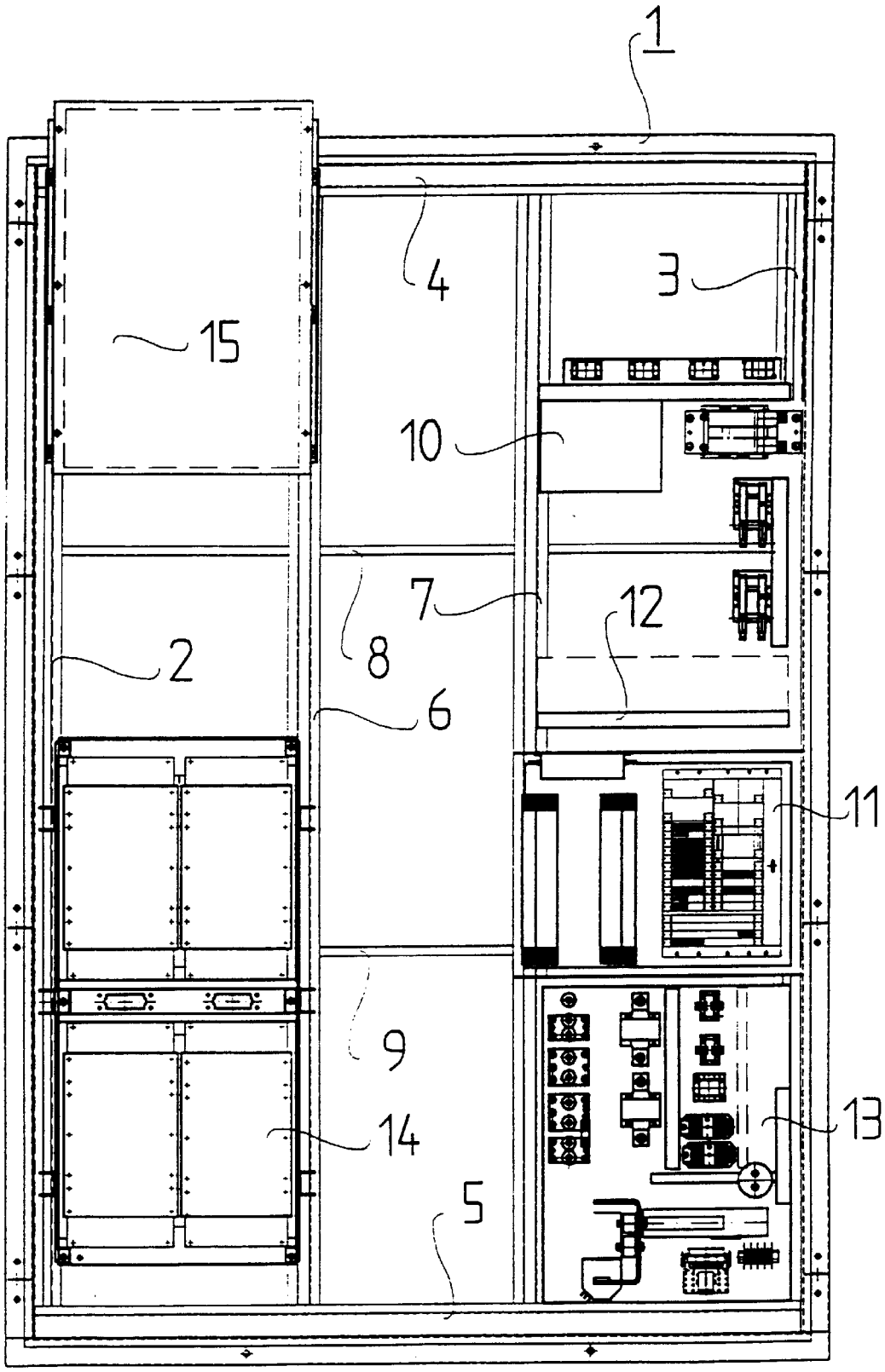
FIG. 2 shows a top view of the base frame according to FIG. 1, with electrical apparatuses mounted.

FIGS. 1 and 2 show the base frame 1 of a roof-mounted container. In the exemplary embodiment shown, base frame 1 has a rectangular shape, and includes two longitudinal supports 2 and 3, and two transversal supports 4 and 5.

In the exemplary embodiment, two additional longitudinal supports 6 and 7, and two additional transversal supports 8 and 9 are arranged in base frame 1 These supports allow electric apparatuses and plates (component boards) to be mounted on base frame 1 in a simple manner.

Figure 3:
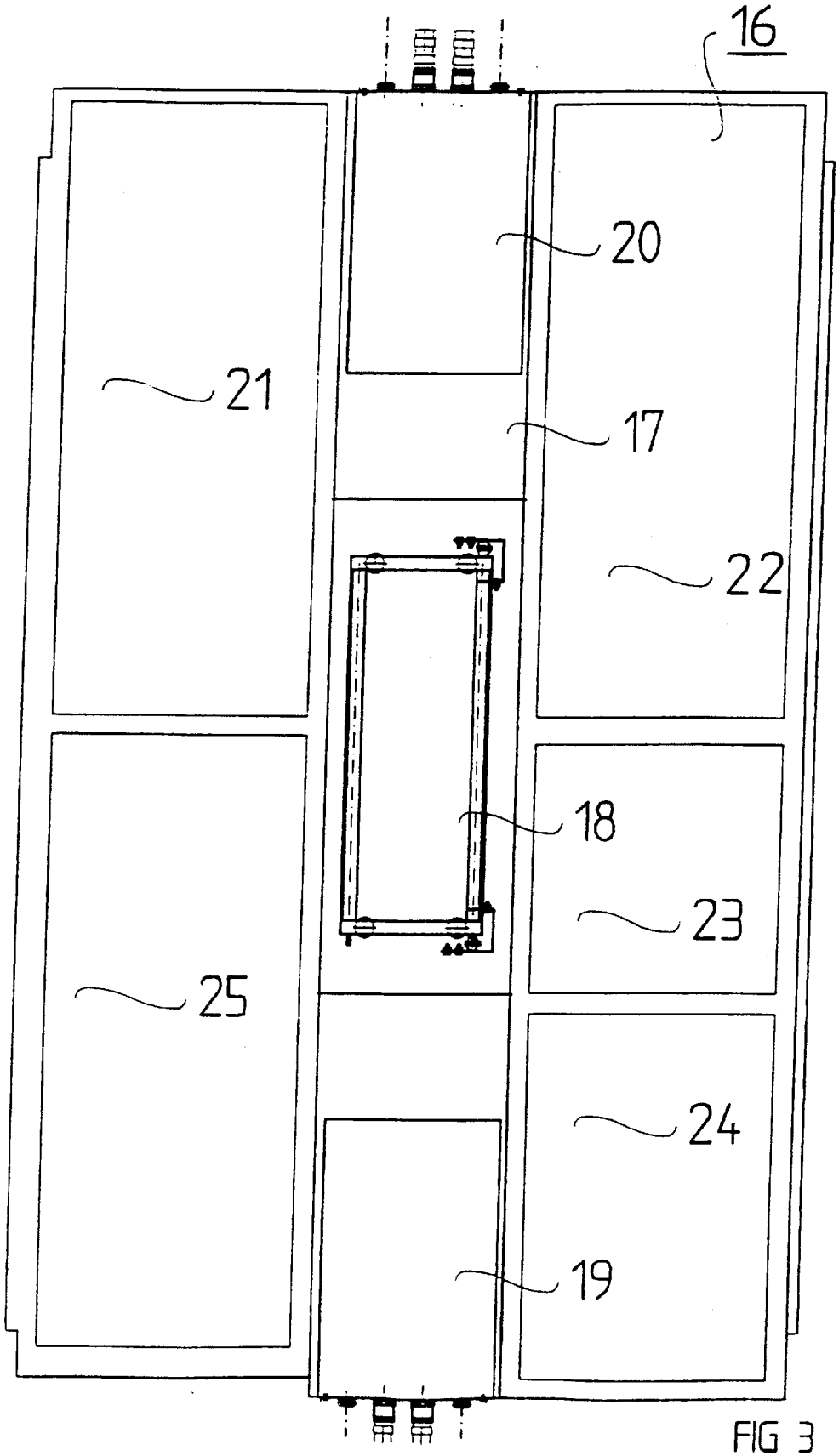
FIG. 3 shows a top view of a hood that is mounted on the base frame of FIG. 1.

As illustrated in FIG. 2, in the exemplary embodiment of the present invention, base frame 1 supports an on-board electrical system distributor 10, a drive controller 11, an additional contact board 12 and a converter board 13. Furthermore, an engine converter 14 and an on-board system converter 15 are set up on base frame 1. The central area of base frame 1 is kept free. A hood 16, which may be set on base frame 1, has a channel 17 in its central area (FIG. 3), where a brake resistor 18 is mounted.

Terminal boxes 19 and 20 are mounted at both ends of channel 17. The terminal boxes contain the terminals for the electrical distribution, the electrical continuity, and the electrical link adapter.

The hood 16 includes hood covers 21 through 25, which can be swung open from the center of the car.

Figure 4:
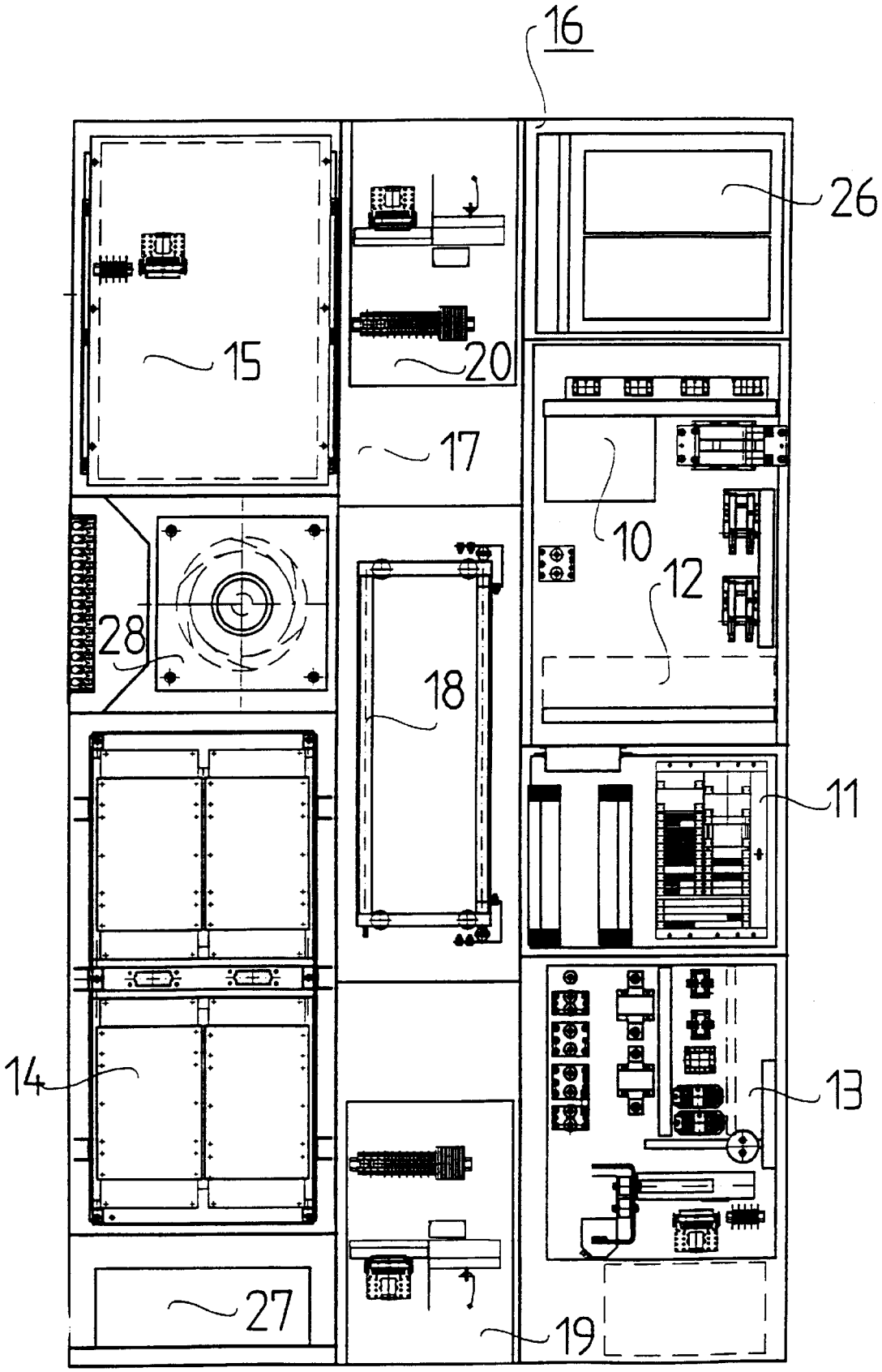
FIG. 4 shows a top view of a roof-mounted container, completely equipped, with the hood cover open.

As shown in FIG. 4, in addition to the brake resistor 18, a battery 26, a reactor 27, and a fan unit 28 may also be arranged in the hood 16.

What is claimed is:

1. A car body, comprising:

a roof-mounted container for accommodating a plurality of electrical apparatuses of a drive and a car control of rolling stock, the roof-mounted container including a rectangular base frame including two longitudinal supports and two transversal supports, at least one of i) at least one further longitudinal support, and ii) at least one further transversal support, arranged within the base frame, and at least one hood mounted on the base frame;

wherein the base frame is mounted on a portal support of the car body and is sealed against at least one endwall of the car body and at least one sidewall of the car body.

2. The car body according to claim 1, wherein the base frame is composed of an electrically conducting material.

3. The car body according to claim 1, wherein the base frame is composed of an electrically insulating material.

4. The car body according to claim 1, wherein the at least one hood is composed of an electrically conducting material.

5. The car body according to claim 1, wherein the at least one hood is composed of an electrically insulating material.

6. The car body according to claim 4, wherein the electrically insulating material is a fiberglass-reinforced plastic.

7. The car body according to claim 1, wherein the at least one hood is one of screwed and welded onto the base frame.

8. The car body according to claim 1, wherein the at least one hood includes at least one hood cover.

9. The car body according to claim 7, wherein the at least one hood cover is capable of being pivoted open from a center of the car body.

10. The car body according to claim 1, wherein the base frame has a bottom, the bottom being covered by a frame cover.

11. The car body according to claim 1, further comprising:

a housing arranged on the base frame for accommodating at least one power line.

12. The car body according to claim 10, wherein the housing is one of screwed and welded onto the base frame.

13. The car body according to claim 10, wherein the housing is closed by a housing cover.

14. The car body according to claim 12, wherein the housing cover is removable.

15. The car body according to claim 1, wherein the at least one hood includes a channel extending in a direction parallel to a longitudinal axis of the at least one roof-mounted container, the channel being positioned in a center of the at least one hood, and a terminal box positioned at one of a first end of the channel and a second end of the channel.

* * * * *